US008270659B2

(12) United States Patent
Koizumi et al.

(10) Patent No.: US 8,270,659 B2
(45) Date of Patent: Sep. 18, 2012

(54) SPEAKER SYSTEM AND VIDEO DISPLAY

(75) Inventors: Makoto Koizumi, Tokyo (JP); Hiroyuki Nakamura, Kanagawa (JP); Katsuhiro Yamashita, Tokyo (JP)

(73) Assignee: Sony Corporation, Tokyo (JP)

( * ) Notice: Subject to any disclaimer, the term of this patent is extended or adjusted under 35 U.S.C. 154(b) by 1413 days.

(21) Appl. No.: 11/637,010

(22) Filed: Dec. 12, 2006

(65) Prior Publication Data

US 2007/0147648 A1 Jun. 28, 2007

(30) Foreign Application Priority Data

Dec. 28, 2005 (JP) ..... P2005-379435

(51) Int. Cl.
*H04R 1/02* (2006.01)

(52) U.S. Cl. ..... 381/386; 381/87; 381/333; 381/388; 348/825; 348/836

(58) Field of Classification Search ..... 381/306, 381/87, 333–334, 150, 386, 385; 348/825, 348/836

See application file for complete search history.

(56) References Cited

U.S. PATENT DOCUMENTS

| | | | | |
|---|---|---|---|---|
| 5,678,089 | A * | 10/1997 | Bacs et al. | 396/324 |
| 5,868,475 | A * | 2/1999 | Shikata et al. | 312/7.2 |
| 7,403,632 | B2 * | 7/2008 | Goldberg | 381/415 |
| 2004/0239619 | A1 | 12/2004 | Takahashi et al. | |
| 2005/0036640 | A1 * | 2/2005 | Goldenberg | 381/334 |

FOREIGN PATENT DOCUMENTS

| | | |
|---|---|---|
| JP | 05-291403 | 11/1993 |
| JP | 06-245192 | 9/1994 |
| JP | 07-007639 | 1/1995 |
| JP | 09-214967 | 8/1997 |
| JP | 09-282349 | 10/1997 |
| JP | 09-319788 | 12/1997 |
| JP | 2001-223918 | 8/2001 |
| JP | 2001-268394 | 9/2001 |
| JP | 3603885 | 10/2004 |
| JP | 2006-174138 | 6/2006 |

* cited by examiner

*Primary Examiner* — Devona E. Faulk
*Assistant Examiner* — Disler Paul
(74) *Attorney, Agent, or Firm* — Finnegan, Henderson, Farabow, Garrett & Dunner, L.L.P.

(57) ABSTRACT

Disclosed herein is a speaker system including a speaker unit with a speaker body incorporated therein; and a speaker panel disposed on the front side of the speaker unit; wherein the speaker panel has a multiplicity of fine holes permitting a sound of the speaker body to pass therethrough, and has an opaque part hiding the presence of the speaker unit, and a transparent part in the periphery of the opaque part.

6 Claims, 10 Drawing Sheets

SPEAKER SYSTEM AND VIDEO DISPLAY

CROSS REFERENCES TO RELATED APPLICATIONS

The present invention contains subject matter related to Japanese Patent Application JP 2005-379435 filed in the Japanese Patent Office on Dec. 28, 2005, the entire contents of which being incorporated herein by reference.

BACKGROUND OF THE INVENTION

1. Field of the Invention

The present invention relates to a speaker system and a video display with the speaker system incorporated therein.

2. Description of the Related Art

In a video display such as a rear projection display and a plane type television set, a speaker system or systems are incorporated adjacently to the screen for displaying a picture. Here, the speaker system includes a speaker unit with a speaker body incorporated therein, and a speaker panel disposed on the front side of the speaker unit. In this case, the speaker panel is usually provided with a multiplicity of holes permitting the sounds generated from the speaker body to pass therethrough (refer to, for example, Japanese Patent No. 3603885).

SUMMARY OF THE INVENTION

In such a configuration in related art, the speaker panel has been provided with comparatively large holes of 1.0 to 2.0 mm in diameter, and the speaker unit has been disposed on the rear side of the speaker panel. Therefore, the presence of the speaker has been recognized at a glance from the front side, which would spoil the beauty on a design basis.

Thus, there is a need to adopt a novel configuration for a speaker system and thereby to provide a speaker system and a video display which are excellent in design.

According to an embodiment of the present invention, there is provided a speaker system including a speaker unit with a speaker body incorporated therein, and a speaker panel disposed on the front side of the speaker unit, wherein the speaker panel is provided with a multiplicity of fine holes permitting a sound of the speaker body to pass therethrough, and is provided with an opaque part hiding the presence of the speaker unit, and a transparent part in the periphery of the opaque part.

In this configuration, preferably, a gradation gradually varied in transparency from the opaque part to the transparent part is provided between the opaque part and the transparent part.

Besides, in the present invention, the speaker panel may include a transparent panel base, and a transparent sheet adhered to a front surface of the panel base, and the sheet may be colored to form the opaque part.

Further, in this configuration, a portion, corresponding to the opaque part of the sheet, of the panel base is desirably colored in a color in the same group as the color of the opaque part.

In the present invention, the speaker panel disposed on the front side of the speaker unit is provided with a multiplicity of fine holes permitting the sound of the speaker body to pass therethrough, and is provided with the opaque part hiding the presence of the speaker unit, and the transparent part in the periphery of the opaque part, whereby the presence of the speaker unit is not recognizable at a glance, and it is possible to provide a speaker system and a video display which are excellent in design.

Further, in the present invention, by providing between the opaque part and the transparent part the gradation gradually varied in transparency from the opaque part to the transparent part, a more beautiful design can be realized.

In the present invention, furthermore, the speaker panel may include the transparent panel base, and the transparent sheet adhered to the front surface of the panel base, and the sheet may be colored to form the opaque part, whereby the presence of the speaker can be hidden with a simple configuration.

In this configuration, the portion, corresponding to the opaque part of the sheet, of the panel base may be colored in a color in the same group as the color of the opaque part, whereby the ground color of the panel base is prevented from interfering with the opaque part of the sheet, so that a beautiful design can be maintained assuredly.

The above and other features and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
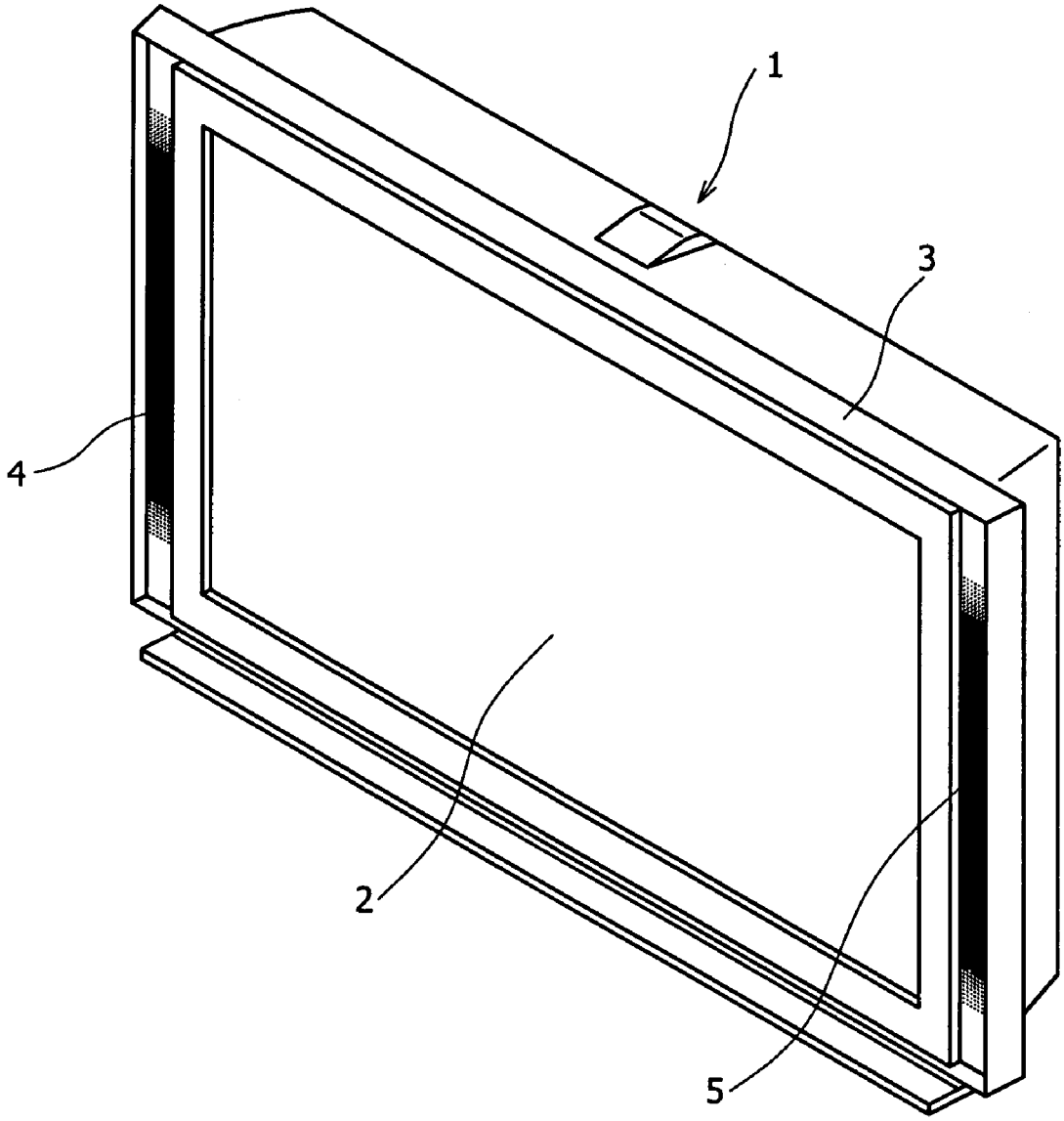
FIG. 1 is a perspective view of a rear projection display.

Now, embodiments of the present invention will be described in detail below referring to the drawings.

Figure 2:
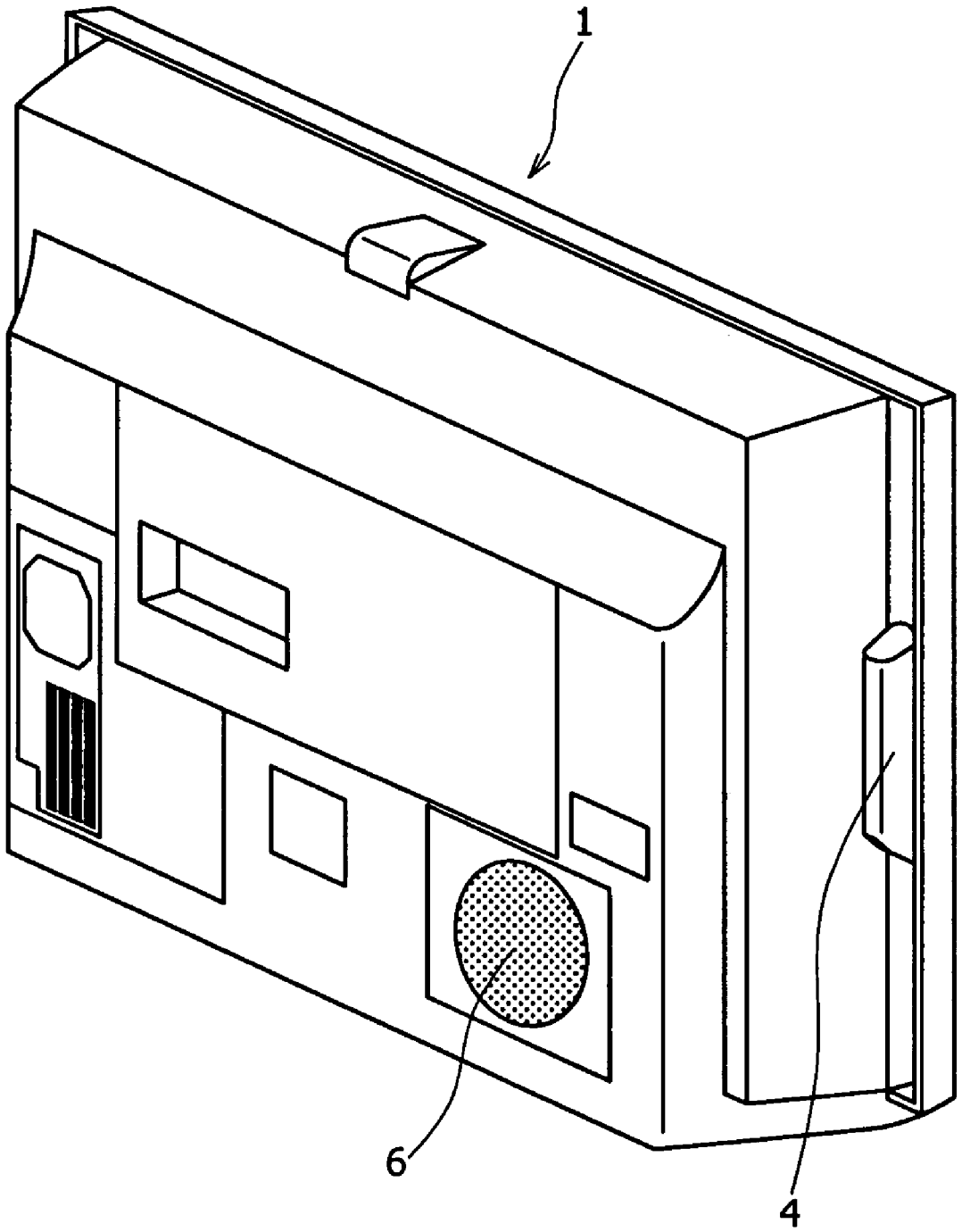
FIG. 2 is a perspective view, from the rear side, of the rear projection display.

FIG. 1 is a perspective view, from the front side, of a rear projection display as an example of a video display, and FIG. 2 is a perspective view, from the rear side, of the rear projection display.

The rear projection display 1 has a picture projection unit incorporated on the rear side of a screen (display screen) 2 provided on the front side, and a picture projected from the picture projection unit is displayed on the screen 2.

In this rear projection display 1, speaker systems 4, 5 and 6 are mounted in left and right side positions adjacent to the screen 2 (on the front side) and on the rear side of the screen 2, respectively. The speaker systems 4 and 5 on the left and right sides of the screen 2 are for respectively reproducing the L channel and the R channel of stereo sounds, and an intermediate-pitch speaker (squawker) and a high-pitch speaker (tweeter) are mounted in each of the speaker systems 4 and 5. Besides, a low-pitch speaker (woofer) is mounted in the speaker system 6 on the rear side.

Figure 3:
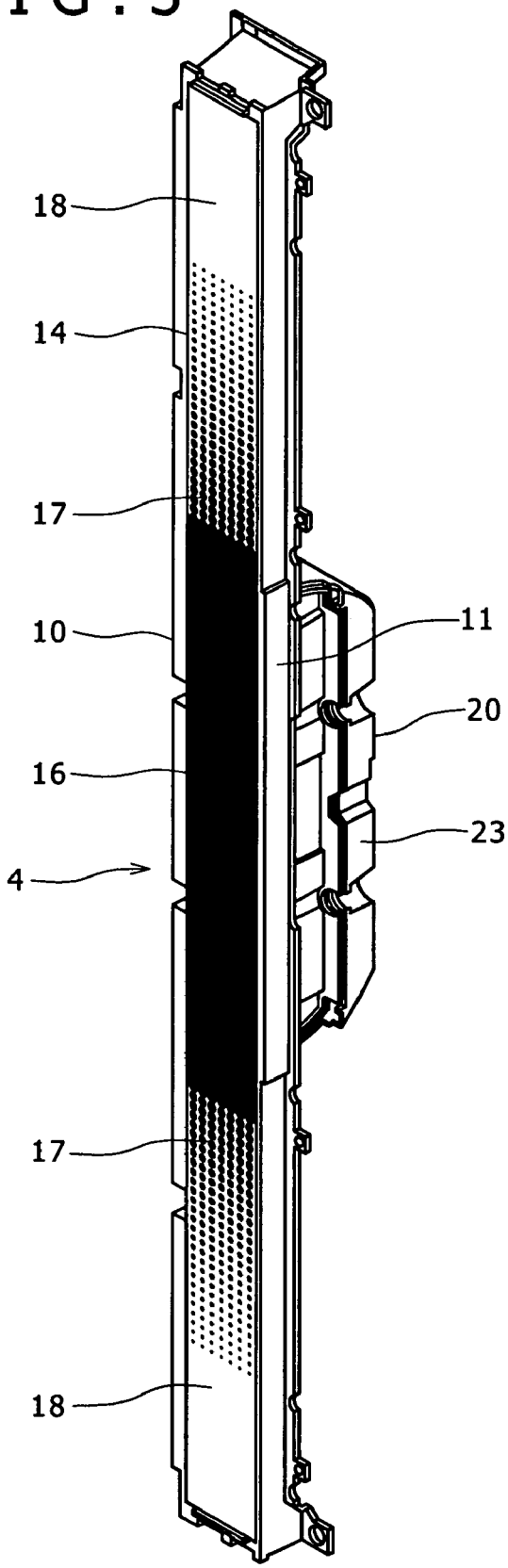
FIG. 3 is a perspective view of a speaker system.
Figure 4:
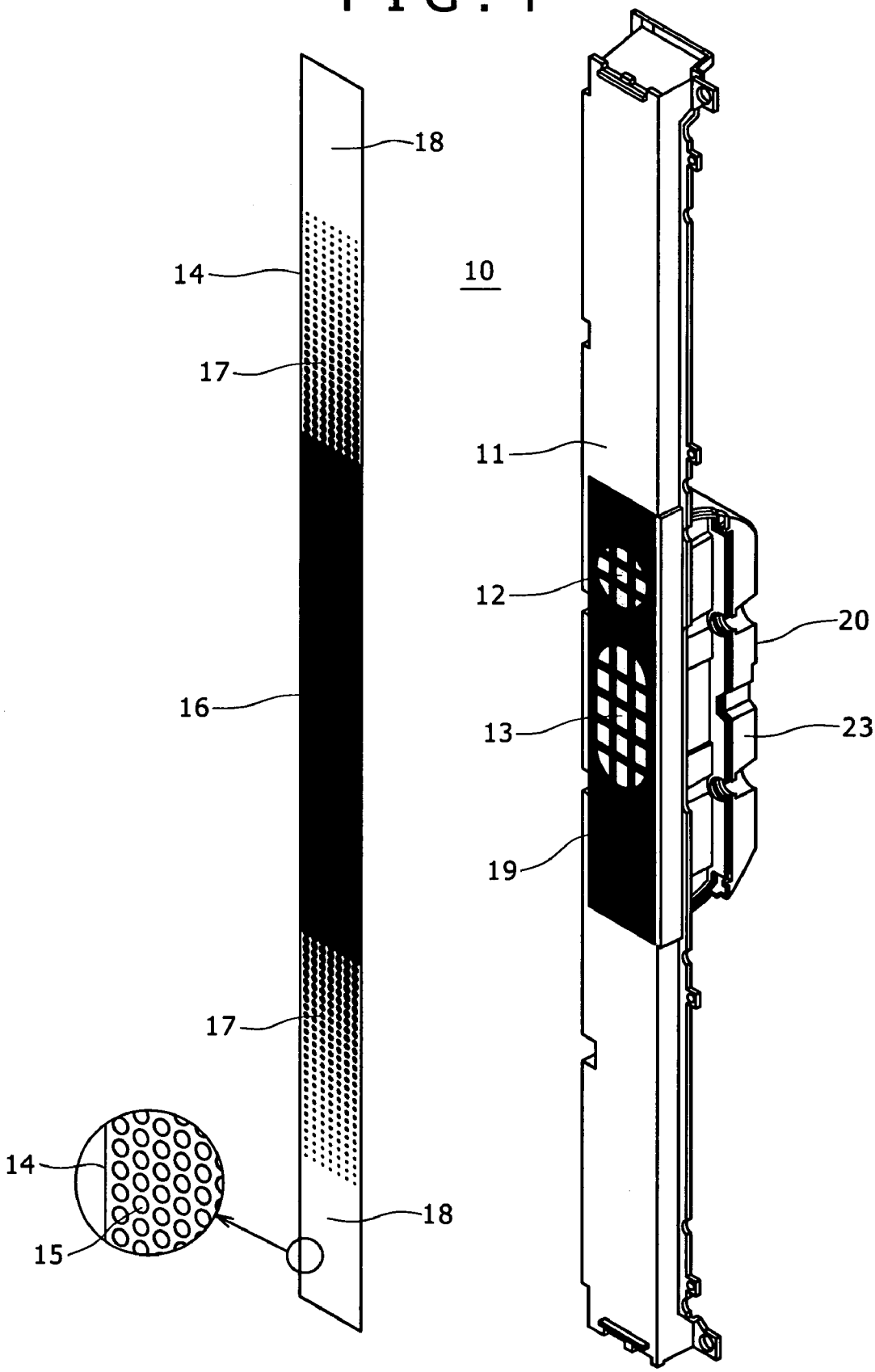
FIG. 4 is an exploded perspective view of the speaker system.

FIG. 3 is a perspective view showing the structure of the speaker system disposed adjacently to the screen, and FIG. 4 is an exploded perspective view of the speaker system. Incidentally, while the structure of the speaker system 4 (for the L channel) on the left side of the screen 2 is shown here, the speaker system 5 (for the R channel) on the right side is the same with (precisely, symmetrical with) the speaker system 4 in structure.

Figure 5:
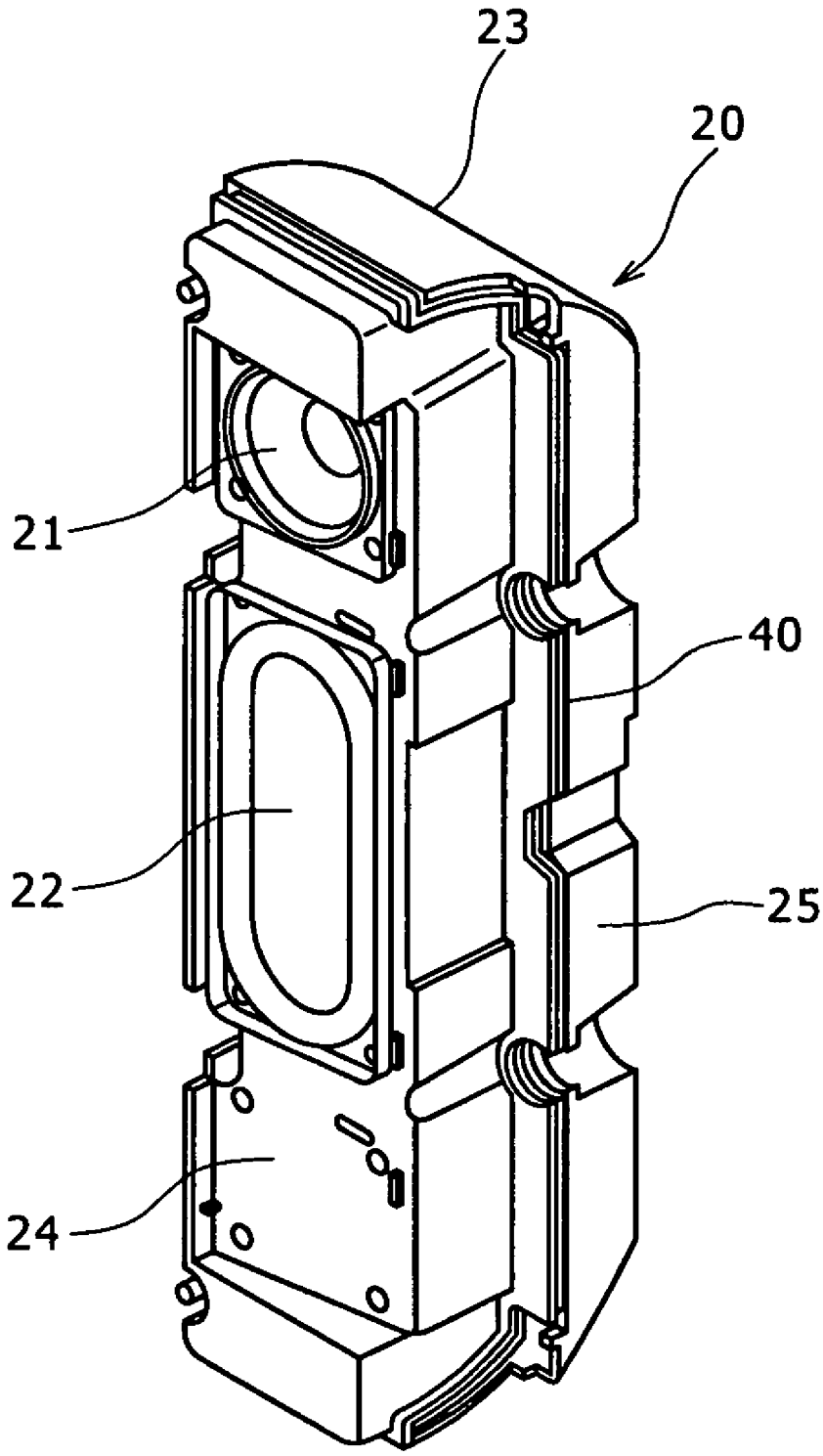
FIG. 5 is a perspective view of a speaker unit.

As shown in FIGS. 3 and 4, the speaker system 4 in this embodiment has a speaker unit 20 with speaker bodies incorporated therein, and a vertically elongate speaker panel 10 disposed on the front side of the speaker unit 20. Here, as shown in FIG. 5, the speaker unit 20 is composed of the speaker bodies (the squawker and the tweeter) 21 and 22, and a speaker box 23 housing the speaker bodies 21 and 22.

On the other hand, as is clear from FIG. 4, the speaker panel 10 includes a panel base 11, and a sheet 14 attached to the front surface of the panel base 11. Here, the panel base 11 is a transparent resin part molded from a transparent resin (the material is PC, PS, ABS or the like) by a high-speed heat cycle molding method, and the speaker unit 20 is screwed to a central portion on the rear side of the panel base 11. A portion, to which the speaker unit 20 is attached, of the panel base 11 is provided with grated form holes 12 and 13 for permitting the sounds generated from the speaker bodies 21 and 22 to pass therethrough. The speaker panel 10 is mounted in position by screwing the panel base 11 to an armor frame body 3 of the display 1.

The sheet 14 attached to the front surface of the panel base 11 is a thin transparent resin sheet (the material is PET, PC, PS or the like) of 0.3 to 0.5 mm in thickness, and is adhered to the panel base 11 by adhesive means such as an adhesive double coated tape. Incidentally, the adhesive means for adhesion between the sheet 14 and the panel base 11 is not limited to the adhesive double coated tape; for example, the adhesion can be achieved by applying a UV-curable adhesive or printing a paste. Alternately, insert molding or the like technique may also be used instead of adhesion.

The sheet 14 is provided with innumerable fine holes 15 of 0.3 to 0.4 mm in diameter such as to be non-recognizable at a glance, and the sounds from the speaker bodies 21 and 22 are emitted to the front side of the speaker system 4 through the above-mentioned holes 12 and 13 in the panel base 11 and through the fine holes 15 in the sheet 14. Incidentally, while the fine holes 15 in the sheet 14 is distributed over the whole area of the sheet 14 in this embodiment, they may be opened only in the area for mounting the speaker unit 20 (the areas corresponding to the holes 12 and 13 formed in the panel base 11).

In the speaker system 4 in this embodiment, the sheet 14 is provided with an opaque part 16 for hiding the presence of the speaker unit 20, and transparent parts 18 in the periphery (in this embodiment, on the upper and lower sides) of the opaque part 16. Further, a gradation 17 increased in transparency gradually from the opaque part 16 to the transparent part 18 is provided between the opaque part 16 and each of the transparent parts 18 of the sheet 14. The opaque part 16 and the parts of the gradations 17 are formed, for example, by subjecting the coloring the sheet 14 to a coloring treatment for coloring in black by coating or printing. The color in the coloring is not limited to black but may be any color that can hide the presence of the speaker unit 20.

When the speaker system 4 configured as above is viewed from the front side, the presence of the speakers is not recognizable at a glance, since the speaker unit 20 is hidden by the opaque part 16. In addition, in the periphery of the opaque part 16, the background of the speaker system 4 is visible through the transparent parts 18, whereby an excellent design can be realized.

Besides, in this configuration, the portion 19, corresponding to the opaque part 16 of the sheet 14, of the panel base 11 is colored in a color in the same group as the color of the opaque part 16. Specifically, since the opaque part 16 of the sheet 14 is black in this embodiment, a coloring treatment by coating or printing in black is adopted, whereby the ground color of the panel base 11 is prevented from interfering with the opaque part 16 of the sheet 14.

The speaker system 4 and the display 1 with the speaker system according to this embodiment as above-described have the following remarkable effects.

In the speaker system and the display according to this embodiment, the speaker panel 10 disposed on the front side of the speaker unit 20 is provided with a multiplicity of the fine holes 15 permitting the sounds of the speaker bodies 21 and 22 to pass therethrough, and is provided with the opaque part 16 for hiding the presence of the speaker unit 20, and the transparent parts 18 in the periphery of the opaque part 16, whereby the presence of the speakers is prevented from being recognized at a glance, and it is possible to provide a speaker system and a display which are excellent in design.

Further, in the configuration according to this embodiment, the gradation 17 gradually varied in transparency from the opaque part 16 to the transparent part 18 is provided between the opaque part 16 and each of the transparent parts 18 of the speaker panel 10. Therefore, it is possible to realize a beautiful design such that a natural transition in look is achieved between the opaque part 16 and the transparent parts 18, and it is possible to provide a speaker system and a display which are excellent in design.

Furthermore, in the speaker system and the display according to this embodiment, the speaker panel 10 includes the transparent panel base 11 and the transparent sheet 14 adhered to the front surface of the panel base 11, and the sheet 14 is colored to form the opaque part 16. Therefore, the presence of the speakers can be hidden by a simple configuration.

Besides, in this configuration, the portion 19, corresponding to the opaque part 16 of the sheet 14, of the panel base 11 is colored in a color in the same group as the color of the opaque part 16. This ensues that the ground color of the panel base 11 does not interfere with the opaque part 16, so that a beautiful design can be maintained assuredly.

Now, the configuration of the speaker unit 20 in the speaker system 4 according to this embodiment will be described more in detail, referring to FIG. 5 and the latter figures.

FIG. 5 is a perspective view of the speaker unit 20. As shown here, the speaker unit 20 is composed of the speaker bodies (the squawker and the tweeter) 21 and 22, and the resin-made speaker box 23 housing the speaker bodies 21 and 22.

Figure 6:
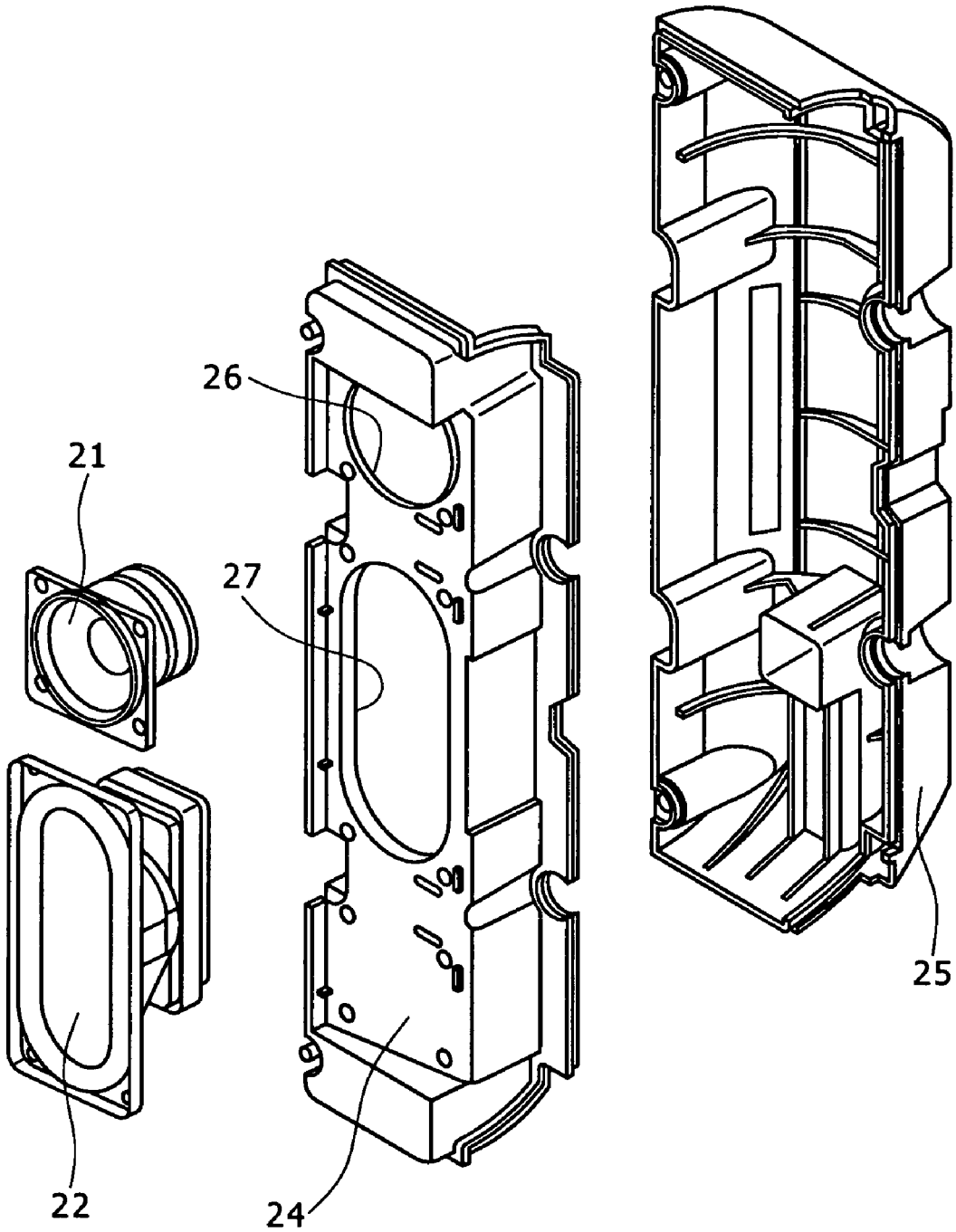
FIG. 6 is an exploded perspective view of the speaker unit.

FIG. 6 is an exploded perspective view of the speaker unit 20. As shown here, the speaker box 23 is composed of a plurality of split bodies, i.e., a front box half 24 and a rear box half 25 in this embodiment, and the split bodies are combined to form a single speaker box. Incidentally, PS, ABS and the like can be favorably used as the material of the speaker box 23.

In the speaker box 23, the front box half 24 is provided on its front side with mounting holes 26 and 27 for mounting the speaker bodies 21 and 22 therein. The speaker bodies 21 and 22 are screwed to the front box half 24 through the mounting holes 26 and 27.

In the speaker box 23 configured by combining the front box half 24 and the rear box half 25 as above-mentioned, generally, the front box half 24 and the rear box half 25 are integrated to each other by use of screws. However, particularly in this embodiment, a method of manufacturing a speaker box by a WIM (Welding In Mold) molding process is adopted, whereby the front box half 24 and the rear box half 25 are integrated to each other without using screws.

The method of manufacturing a speaker box by the WIM molding process will be described referring to FIGS. 8A to 9C. Here, FIGS. 8A to 8C illustrate a primary molding step, and FIGS. 9A to 9C illustrate a secondary molding step.

Figure 8A:
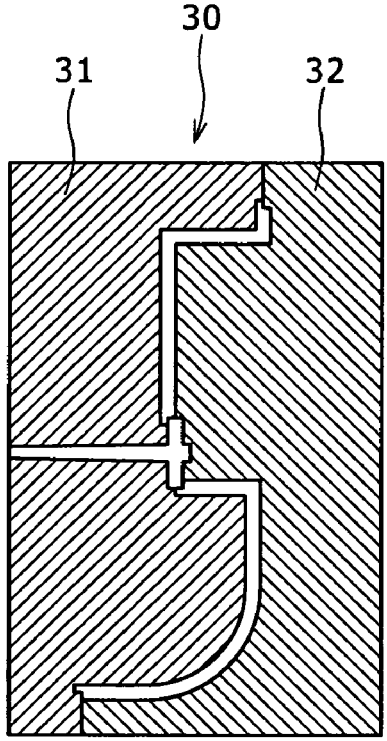
FIGS. 8A to 8C are illustrations of a primary molding step in a method of manufacturing a speaker box.
Figure 8B:
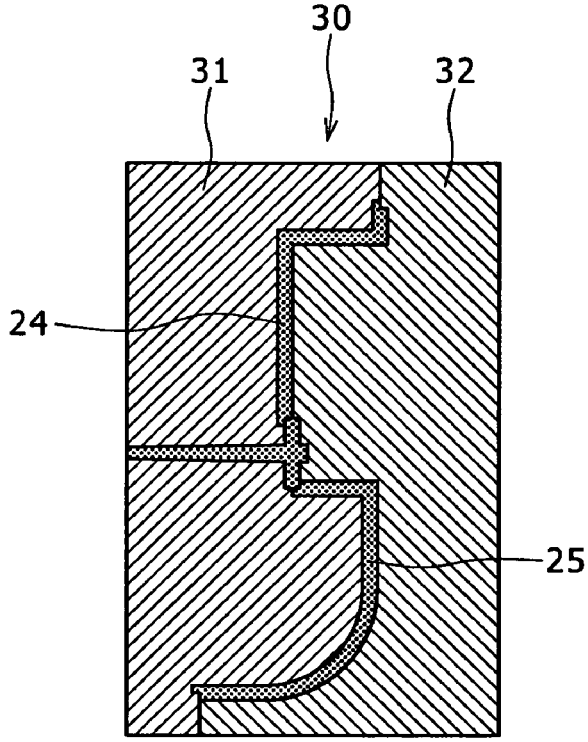
Figure 8C:
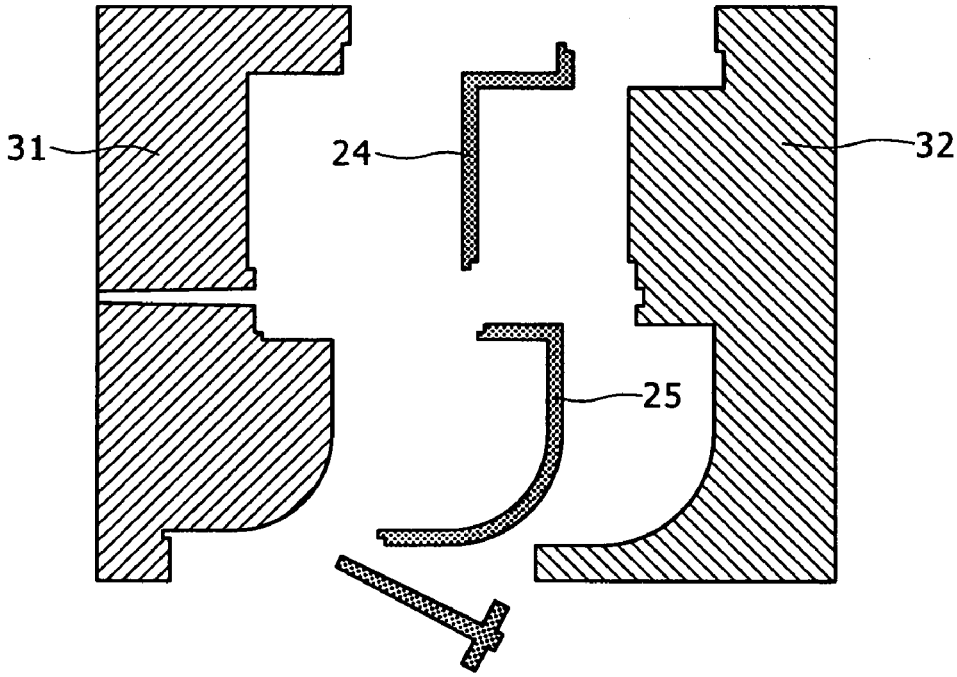

The primary molding step shown in FIGS. 8A to 8C is a step of molding the front box half 24 and the rear box half 25, which are split bodies of the speaker box 23, from a resin. Specifically, in the primary molding step, first, starting from the condition where molds 31 and 32 of a resin-molding mold apparatus 30 are closed as shown in FIG. 8A, and a molten resin is injected into a cavity between the molds 31 and 32 as shown in FIG. 8B, for molding the front box half 24 and the rear box half 25. After the resin is cured, the molds 31 and 32 are opened as shown in FIG. 8C, to take out the moldings, i.e., the front box half 24 and the rear box half 25. In this primary molding step, the front box half 24 and the rear box half 25 are simultaneously molded by use of the single mold apparatus 30, whereby efficient molding is achieved.

Figure 9A:
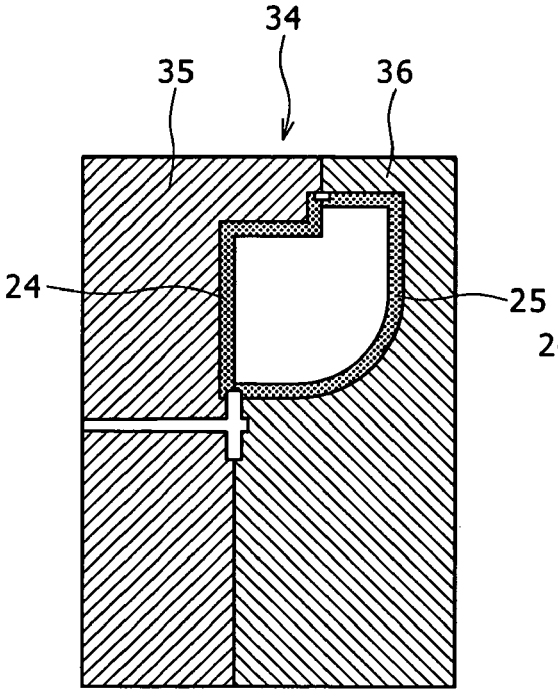
FIGS. 9A to 9C are illustrations of a secondary molding step in the method of manufacturing the speaker box.
Figure 9B:
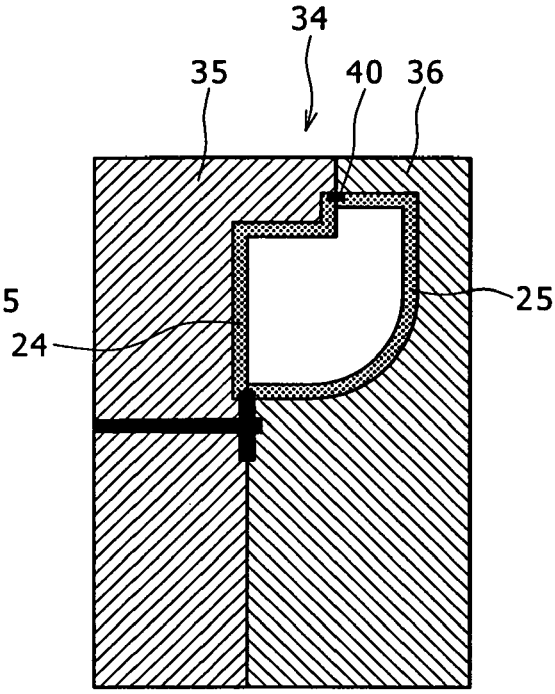
Figure 9C:
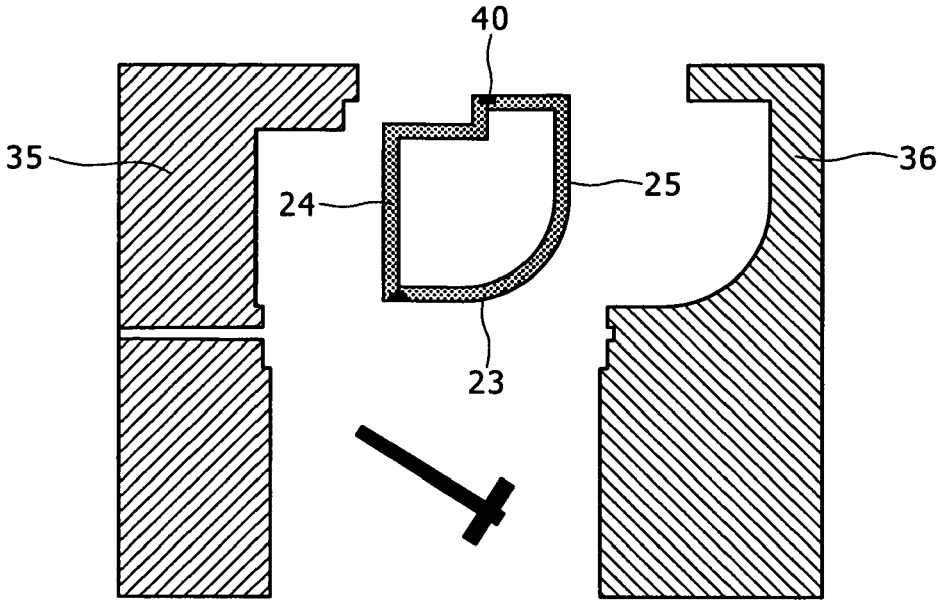

The secondary molding step shown in FIGS. 9A to 9C, subsequent to the primary molding step, is a step of joining the front box half 24 and the rear box half 25 molded in the first molding step. Specifically, in the secondary molding step, first, as shown in FIG. 9A, the front box half 24 and the rear box half 25 in a combined state are placed in a joining mold apparatus 34, and molds 35 and 36 of the molding apparatus 34 are closed. Under this condition, a resin 40 is injected into mating portions of the front box half 24 and the rear box half 25, as shown in FIG. 9B. As a result, the resin 40 and the resin of the front box half 24 and the rear box half 25 are welded to each other, whereby the front box half 24 and the rear box half 25 are integrally joined to each other. After the joining resin 40 is cured, the molds 35 and 36 are opened as shown in FIG. 9C, so as to take out the finished product, i.e., the speaker box 23 formed by integrally joining the front box half 24 and the rear box half 25.

Incidentally, the resin 40 for joining used in the secondary molding step is desirably the same with or similar to the resin of the front box half 24 and the rear box half 25, for the purpose of obtaining more assured adhesion performance.

Figure 10:
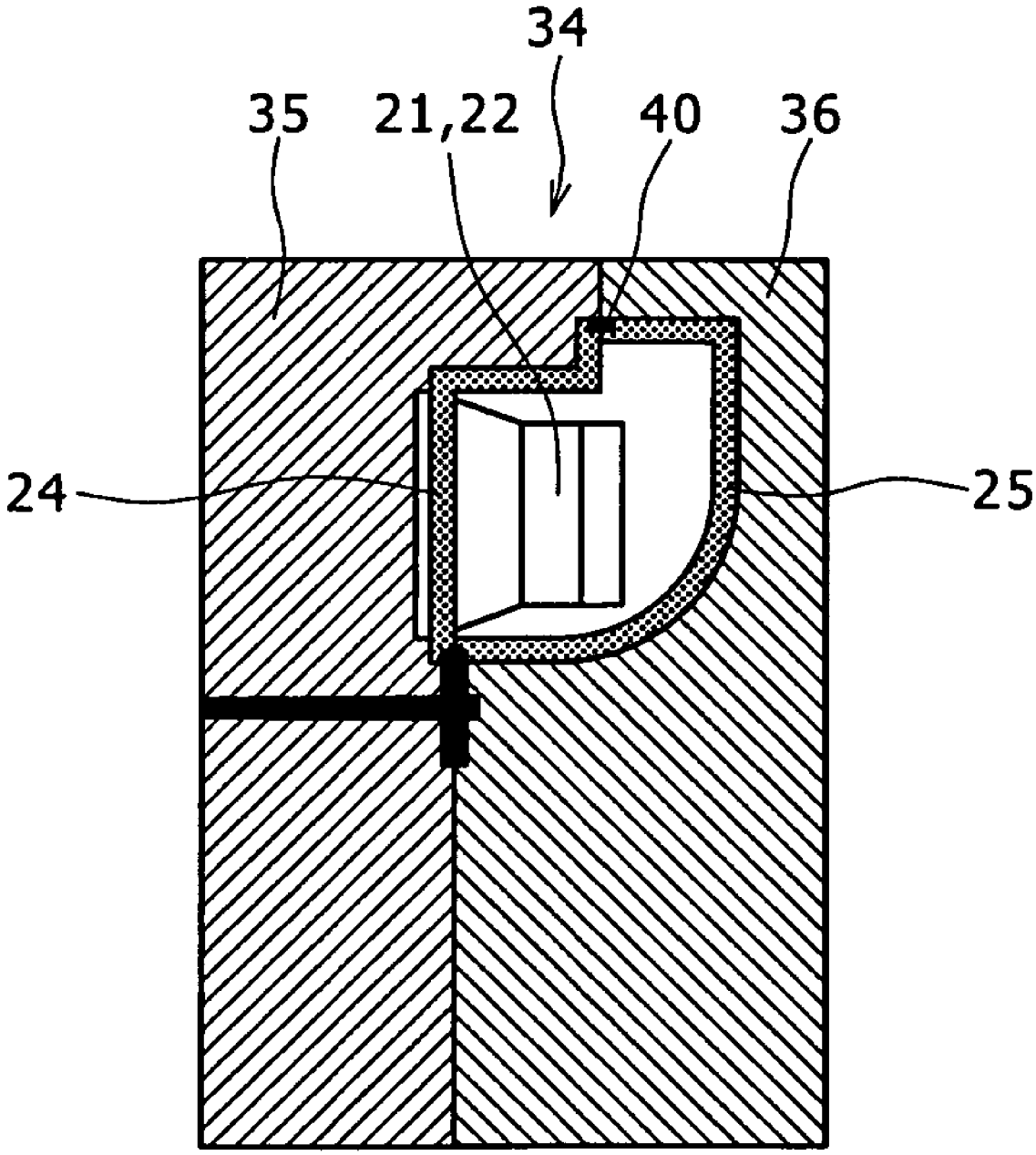
FIG. 10 is an illustration of another example of the secondary molding step.

Then, in this embodiment, the speaker bodies 21 and 22 are screwed to the speaker box 23 formed as above-mentioned, whereby the speaker unit 20 as shown in FIG. 5 is completed. Incidentally, in the secondary molding step, as shown in FIG. 10, a process may be adopted in which the speaker bodies 21 and 22 are preliminarily mounted to the front box half 24, thereafter the front box half 24 and the rear box half 25 are combined with each other, then they in the combined state are placed in the joining mold apparatus 34, and joining of them by the resin 40 is conducted. This process makes it possible to enhance the assembly workability of the speaker system.

As has been described above, in this embodiment, the front box half 24 and the rear box half 25 can be integrated to each other without use of screws, by the method of manufacturing a speaker box including: the primary molding step of molding the front box half 24 and the rear box half 25 from a resin; and the secondary molding step in which the front box half 24 and the rear box half 25 molded in the primary molding step are placed in the joining mold apparatus in the combined state, and the resin 40 is injected to the mating portion of the front box half 24 and the rear box half 25, so as to join the front box half 24 and the rear box half 25 to each other. Therefore, it is possible to effectively reduce the number of steps in the manufacturing line and reduce cost.

In addition, in the speaker box 23, high air-tightness can be secured in integrating the front box half 24 and the rear box half 25 to each other. Therefore, there is no need for such a measure as to add a cushioning material to the mating portion of the front box half 24 and the rear box half 25, so that a further reduction in cost can be achieved.

Further, in the speaker box 23, no screw is used in integrating the front box half 24 and the rear box half 25 to each other. Therefore, there is no possibility that ruggedness due to screw holes or the like might appear on the outside surface of the speaker box 23, so that a speaker system excellent in design can be provided.

Furthermore, in the speaker box 23, the front box half 24 and the rear box half 25 are simultaneously molded in the single mold apparatus 30 in the primary molding step, whereby manufacturing efficiency can be further enhanced.

Besides, in the speaker box 23, as shown in FIG. 5, the mating portion of the front box half 24 and the rear box half 25 is joined by the resin 40 over substantially the entire perimeter. This makes it possible to provide the speaker box 23 with a more assured air-tightness, and to provide a high-tone-quality speaker system.

Figure 7A:
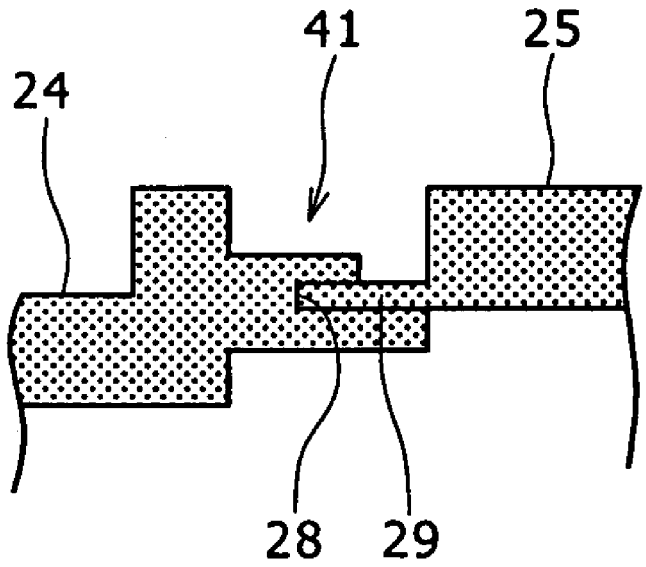
FIGS. 7A and 7B are sectional views of a mating portion of a front box half and a rear box half of a speaker box.
Figure 7B:
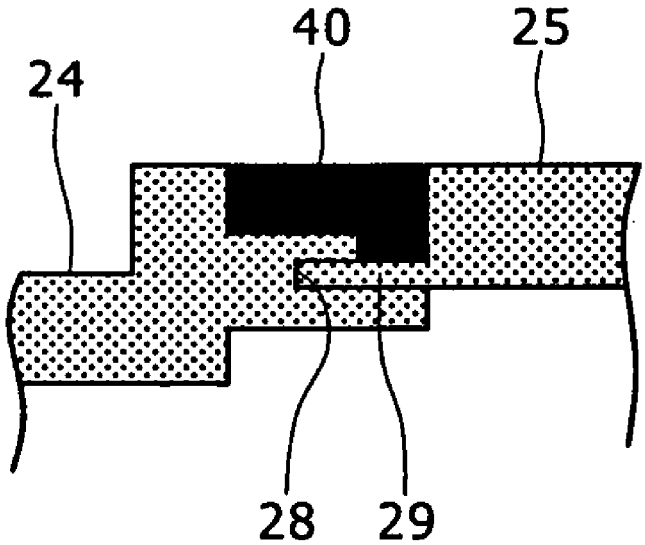

FIGS. 7A and 7B are sectional views of a mating portion of the front box half 24 and the rear box half 25 in the speaker box 23. Here, a projected edge portion 29 provided on the rear box half 25 side is fitted in a groove portion 28 provided on the front box half 24 side, whereby the front box half 24 and the rear box half 25 can be accurately combined with each other.

As shown in FIG. 7A, an outer peripheral portion of the mating portion of the front box half 24 and the rear box half 25 is provided with a recessed groove 41 over the entire perimeter, and, in the secondary molding step, the portion of the recessed groove 41 is filled up with the joining resin 40 as shown in FIG. 7B. This makes it possible to more assuredly join the front box half 24 and the rear box half 25 to each other with the resin 40. Besides, since the joining resin 40 does not protrude beyond the outside surface of the speaker box 23, it is possible to provide a speaker system more excellent in design.

While the embodiments of the present invention has been described in detail above, the invention is not to be limited to the configurations in the embodiments, and other various embodiments are naturally possible within the scope of the invention.

What is claimed is:

1. A speaker system, comprising:

a speaker unit with a speaker body incorporated therein; and a speaker panel disposed on a front side of said speaker unit, wherein said speaker panel has a multiplicity of fine holes permitting a sound of said speaker body to pass therethrough, an opaque part hiding a presence of said speaker unit, and a transparent part in a periphery of said opaque part, wherein said speaker panel includes a transparent panel base, and a transparent sheet adhered to a front surface of said panel base, and said sheet is colored to form said opaque part, and wherein the multiplicity of fine holes are distributed over a whole area of the transparent sheet but opened only in an area for mounting the speaker unit.

2. The speaker system as set forth in claim 1, wherein a gradation gradually varied in transparency from said opaque part to said transparent part is provided between said opaque part and said transparent part.

3. The speaker system as set forth in claim 1, wherein a portion, corresponding to said opaque part of said sheet, of said panel base is colored in a color in the same group as the color of said opaque part.

4. A video display, comprising:

a speaker system incorporated adjacently to a screen for displaying a picture;

wherein said speaker system includes a speaker unit with a speaker body incorporated therein, and a speaker panel disposed on a front side of said speaker unit, wherein said speaker panel has a multiplicity of fine holes permitting a sound of said speaker body to pass therethrough, an opaque part hiding a presence of said speaker unit, and a transparent part in a periphery of said opaque part, wherein said speaker panel includes a transparent panel base, and a transparent sheet adhered to a front surface of said panel base, and said sheet is colored to form said opaque part, and wherein the multiplicity of fine holes are distributed over a whole area of the transparent sheet but opened only in an area for mounting the speaker unit.

5. The video display as set forth in claim 4, wherein a gradation gradually varied in transparency from said opaque part to said transparent part is provided between said opaque part and said transparent part.

6. The video display as set forth in claim 4, wherein a portion, corresponding to said opaque part of said sheet, of said panel base is colored in a color in the same group as the color of said opaque part.

* * * * *